United States Patent [19]

McIntyre

[11] Patent Number: 4,871,593

[45] Date of Patent: Oct. 3, 1989

[54] METHOD OF STREAKLESS APPLICATION OF THIN CONTROLLED FLUID COATINGS AND SLOT NOZZLE - ROLLER COATER APPLICATOR APPARATUS THEREFOR

[75] Inventor: Frederic S. McIntyre, Wellesley, Mass.

[73] Assignee: Acumeter Laboratories, Inc., Marlborough, Mass.

[21] Appl. No.: 169,389

[22] Filed: Mar. 17, 1988

[51] Int. Cl.[4] ..... B05D 1/40

[52] U.S. Cl. ..... 427/428; 118/249; 118/259; 118/266; 427/429; 427/333

[58] Field of Search ..... 427/428, 429, 333; 118/249, 259, 266

[56] References Cited

U.S. PATENT DOCUMENTS

| | | | |
|---|---|---|---|
| 3,010,845 | 11/1961 | Schornstheimer | 118/259 X |
| 3,498,262 | 3/1970 | Hill et al. | 118/259 |
| 3,595,204 | 7/1971 | McIntyre et al. | 118/8 |
| 4,465,544 | 8/1984 | Fischer et al. | 118/259 X |
| 4,517,916 | 5/1985 | Barch | 118/259 X |
| 4,565,217 | 1/1986 | McIntyre | 137/625 |
| 4,569,864 | 2/1986 | McIntyre | 118/249 X |
| 4,588,470 | 5/1986 | Abegglen | 118/259 X |
| 4,773,136 | 9/1988 | Seydel et al. | 118/266 |

OTHER PUBLICATIONS

Acumeter Laboratories bulletin, "For Cost Effective Tape and Label Manufacturing", 1986.

*Primary Examiner*—Shrive Beck

*Attorney, Agent, or Firm*—Rines and Rines; Shapiro and Shapiro

[57] ABSTRACT

A novel combined hot melt and other fluid preferably slot nozzle-roller coater assembly and technique enabling elimination of streaks and other aberrations caused by undissolved particles or dust and the like in the fluid, and adapted for multi-fluid mixing, if desired.

34 Claims, 4 Drawing Sheets

METHOD OF STREAKLESS APPLICATION OF THIN CONTROLLED FLUID COATINGS AND SLOT NOZZLE - ROLLER COATER APPLICATOR APPARATUS THEREFOR

The present invention relates to the application to substrates of fluid coatings as of hot melt materials, adhesive materials, including radiation-curable or settable materials, and also lower temperature fluid coating materials, being more particularly directed to the high-speed application to a web or sheet substrate of controlled thin coatings exiting under metered pressure from slot type nozzle orifices which normally can entrap particles that cause coating streaks and other non-uniform discontinuities, and to the elimination of such aberrations.

Turning more specifically to such coating streaking and other aberrant effects, these result from dust or similar particles of small size or undissolved components as of undissolved polymers and other degraded elements, such as those that are products of extended heating existent within the coating material as supplied to the coating head or applicator, including applicators of the before-mentioned slot opening type nozzles, such as those described in U.S. Pat. No. 3,595,204. These effects have restricted the potential thinness of perfect coatings and more generally have required the art to accept some longitudinal streaks in the coated surface on the web substrate.

It is therefore, in important measure, that the present invention is directed to the elimination of such and related deleterious defects in coatings, it being an object of the invention to provide a new and improved method of streakless fluid application and improved apparatus particularly suitable therefor, and preferably of the slot nozzle orifice type.

A further object is to provide such a novel applicator apparatus that combines slot nozzle and roller components in a new cooperative unitary structure for controlled thinness coating of improved quality—continuous, intermittent and otherwise patterned.

An additional object is to provide such novel apparatus of more general utility, as well.

Other and further objects will be pointed out hereinafter and are more particularly delineated in the appended claims.

From its methodology viewpoint, in summary, the invention embraces a method of eliminating streaking effects caused by entrapped particulate matter and the like in the applicating of fluid coating material transversely along a moving web-substrate, that comprises, metering the fluid material along a zig-zag path with transverse expansion intermediate the path parallel to the transverse dimension of the web to produce at an exiting region a flowing transverse sheet of the material with substantially uniform pressure drop and fluid displacement therealong; impinging the exiting fluid sheet of material on an immediately adjacent transversely extending cylindrical surface of rotational axis parallel thereto; rotating the cylindrical surface about its axis to carry the coating upon the cylindrical surface along a circular path away from the region of exiting; drawing the web-to-be-coated past and immediately adjacent a further region of the circular path to cause the rotating cylindrical surface to apply and meter the coating carried thereby to the web substrate; and adjusting the said immediately adjacent positions of the cylindrical surface from the exiting region and the web substrate from the further region of the circular path, while adjusting the cylindrical surface rotational speed synchronously with relation to web speed and the fluid metering, to determine the resultant coating thinness and streak-free nature of the coating.

In its apparatus form, in summary, the invention also embodies apparatus for streakless transverse fluid coating of moving web substrates having, in combination, transverse slot nozzle applicator means receiving metered pressurized fluid coating material and exiting the same through its slot; cylindrical roller means disposed immediately adjacent said slot and extending axially parallel thereto to receive the exiting transverse sheet of fluid coating material upon the adjacent region of the cylindrical surface of the roller means; means for rotating the said cylindrical surface about its axis to carry the coating upon said cylindrical surface away from the slot and said adjacent region along the circular path of travel of the roller to a further region of said circular path where it is to be applied to the web substrate; and means for adjusting the close roller-to-nozzle slot separation and the roller rotational speed with respect to the fluid metering and web substrate speed to determine the resultant coating thinness and its streak-free nature.

Preferred and best mode embodiments and details are hereinafter presented.

The invention will now be described in connection with the accompanying drawings, FIG. 1 of which is a longitudinal cross-sectional diagram of a preferred apparatus for practicing the method underlying the invention, particularly with web substrates of limited tensile strengths or stretching susceptibility, such as non-woven materials and stretchable films and the like;

Figure 1:
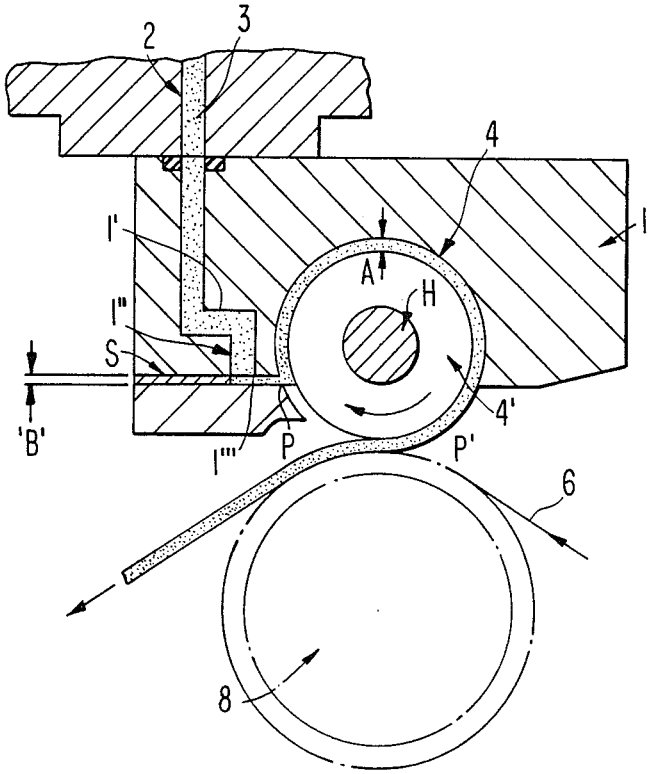
Figure 4:
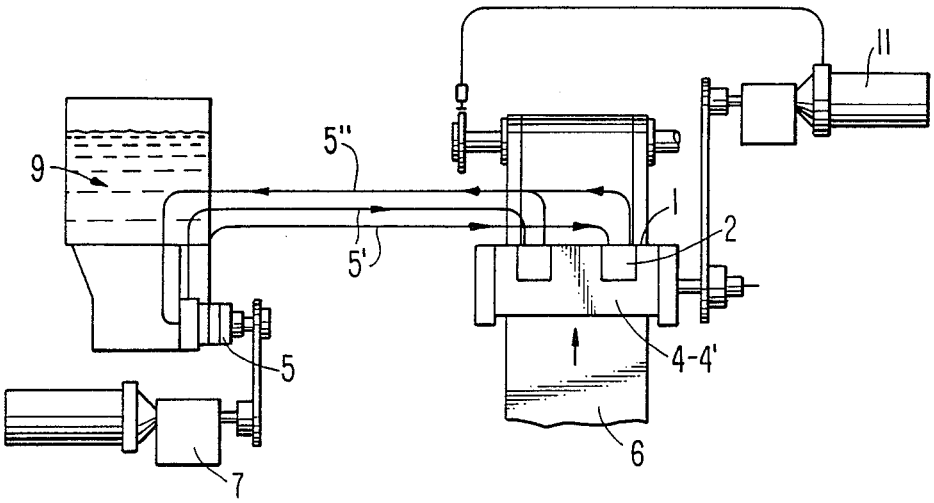
FIG. 4 is system schematic for the apparatus of FIGS. 1 and 2.

Referring to FIG. 1, a slot nozzle of the type described in said Letters Patent is shown for illustrative purposes (other types of slot, line or other applicators being usable with the invention though not with the same degree of proficiency). The preferred nozzle embodies a nozzle body 1 having, on its left-hand side as shown, an input 3 from a metered supply of pressurized fluid coating material, as supplied through poppet valves 2 or similar valving mechanism (U.S. Pat. No. 4,565,217, for example). The fluid material enters an inlet 1' preferably substantially orthogonally entering a narrow expansion or nozzle cavity chamber 1'', extending transversely into the figure of the drawing, for transversely expanding the fluid so as to apply a uniform pressure drop and fluid displacement line or sheet of fluid material exiting from an aperture or opening slot 1''', again preferably substantially orthogonally directed to the direction of flow through the nozzle from the expansion chamber 1'', in zig-zag fashion (1'-1''-1'''), with no direct inlet-to-outlet visibility, as described in the first-named Letters Patent. As explained therein, the metered fluid supply may provide continuous or intermittent fluid flow, as desired. Use with an illustrative example of a hot melt material is shown in the system schematic of FIG. 4, wherein the metering pump 5, under control of a pump speed motor drive 7, applies the hot melt coating material from a delivery tank 9 to the poppet valves 2 of the nozzle 1 via supply line 5'. The fluid return lines is shown at 5''.

To the right of the nozzle body 1, FIG. 1, preferably in the same unitary structure, as shown, a cylindrical channel 4 is formed extending axially parallel to the transversely extending slot 1''' (again into the figure of the drawing) with communication between the slot 1''' and preferably a point P of the channel 4, just below or near the equatorial diameter of the channel, in cross-section. The cylindrical channel serves as an outer housing wall spaced slightly from an inner rotatable parallel coaxial transversely extending cylindrical roller, drum or shaft 4', hereinafter generically termed "roller", which receives the transverse sheet or line of fluid coating material exiting from the immediately adjacent nozzle slot opening 1''' at P, and carries the same on its rotating cylindrical surface upward away from the region P along the circular path within the narrow annular gap A defined between the roller 4' and at least partially surrounding adjacent channel housing surface 4. The fluid is carried around the circular path to a further region P' outside the channel 4 where it is applied to a web or sheet substrate 6 drawn past the further region P' (shown as at or near the south polar region or bottom of the roller 4' in this illustration), as over a resilient back-up positioning roll 8, as, for example, of silicone rubber surface, particularly useful where limited tensile strength or stretchable non-woven or plastic film materials, such as polyethylene, or the like constitute the web substrate 6. As illustrated, the regions P and P' are displaced circumferentially along the circular path of carry of the fluid coating material by the cylindrical surface of the roller 4' more than about 300°, and preferably more than at least 90° or 180°, to provide a metering action of the fluid in the narrow annular gap A, that also has been found to serve the purpose of dissipating otherwise streak-producing particles exiting in the fluid, such as hot melt, from the nozzle slot 1'''.

Figure 3:
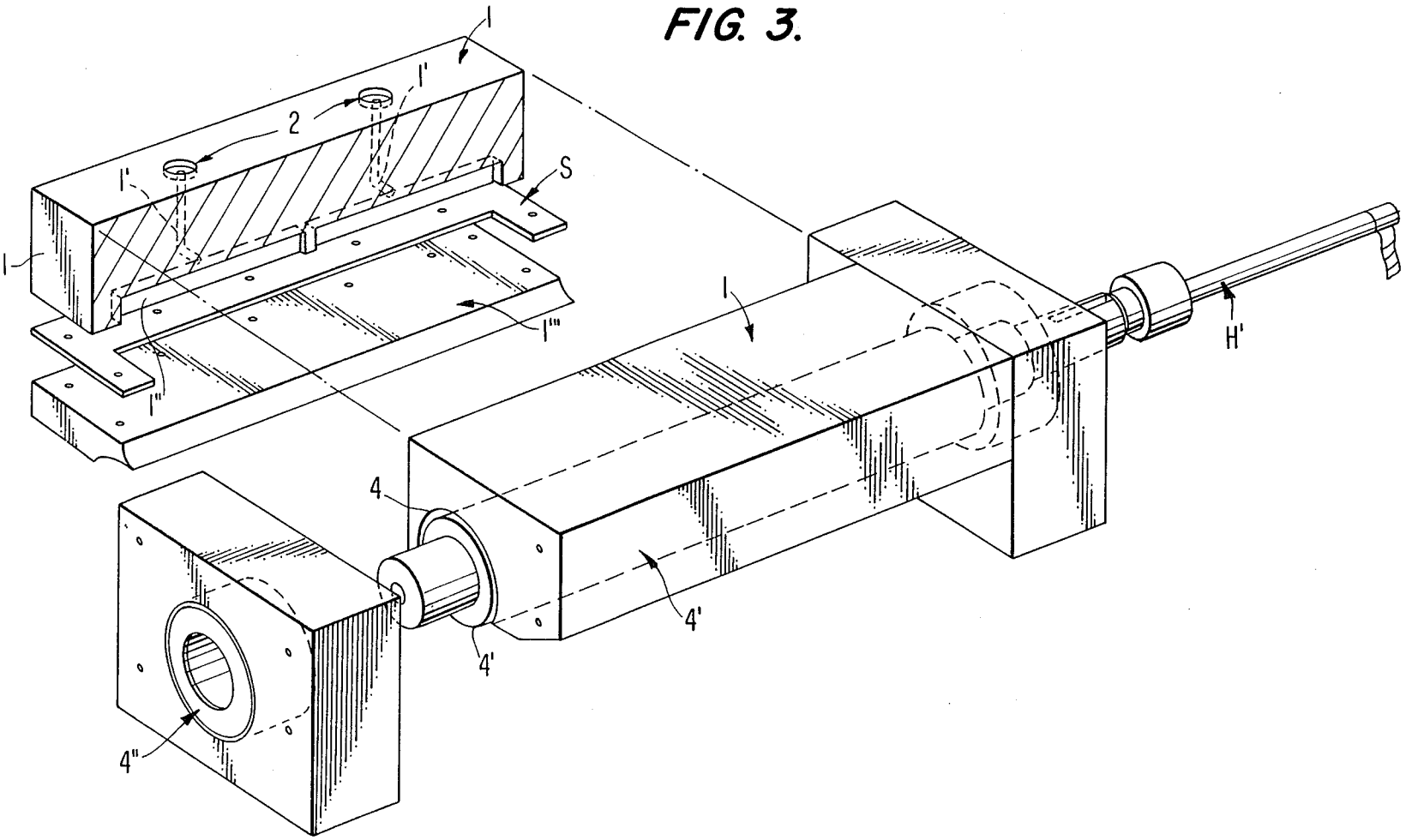
FIG. 3 is an isometric view upon an enlarged scale, partially sectionalized and with the components expanded apart to show details of construction.

It has been found that such metering and control of the thickness (or thinness) of the coating, while enabling streakless coating of the web 6 by self-purging of particulate matter, is achieved through the adjustment of the orifice B of the nozzle slot 1''', as by appropriate shims S, FIGS. 1 and 3, (full slot as in FIG. 3, or segmented or patterned to enable single or multiple coating stripes), the adjustment of the annular gap A, and the rotational speed of the roller 4', with its diameter as well as its rotational speed also being adjusted in accordance with the desired coating width and weight thereof, as later discussed. Particularly where hot melt coating materials are used, as of H. B. Fuller Co. Type 1597 pressure sensitive rubber-based adhesive, Malcom Nichol Co. ethylene vinyl acetate and wax Type No. 2-2289, Findley Adhesive Co. synthetic rubber-based pressure sensitive adhesive, Type 810376, for example, the roller 4' is preferably internally heated as at H, the roll heater and rotary union therefor H' extending axially within the roller 4' and being shown in the exploded view of FIG. 3, as well as the roller bearings 4'' in their bearing/seal blocks. The back-up roll 8 may also be temperature controlled (heated or cooled) to accommodate for the desired coating temperature of application at P'.

Synchronization of process or web speed (as by the applicator speed motor drive 11 of FIG. 4) with fluid supply through the poppet valves 2 and roller rotational speed, in consort with adjustment of the before-mentioned dimensions A and B, will enable streakless thin coating over wide web speed ranges (50 to 660 feet per minute, for example) of a wide variety of fluid coating materials including, in addition to hot melt materials as above delineated, Dynamite Nobel Co. co-polyester pressure-sensitive adhesive Type 1330, Rohm and Haas Co. emulsion acrylic Type PS-83, and H. B. Fuller solvent rubber-base adhesive, Type SC1341EN, as examples.

As practical examples, for hot melt type materials, the nozzle orifice B may be adjusted within a range of about 0.008'' to 0.125''. To produce a streakless coating weight or thinness of about 1 mil with a one-inch diameter roller 4' (3.14 inch in circumference, for example), on a web 6 longitudinally driven at a web speed of 660 feet per minute, and over a transverse width of 10.5 inches, the gap dimension A should be adjusted to about 20 mil (500 microns) and the rotational speed of the roller 4' should be about 50 rpm.

For a somewhat larger diameter roller 4', say of 2 inches in diameter (6.28 inches in circumference) and the same web and roller speeds, but for a wider coating width of about 28.25 inches and a somewhat thicker coating of weight 2 mils thick, the gap A may not need further adjustment. As previously described, if a stronger tensile-strength web material or substrate is employed, as of paper or the like, the web 6' (FIG. 2) may be drawn past coating application region P' by a pair of rolls R on either side thereof straddling the same; the rolls then preferably being adjustable for web postitioning and as of steel.

The before-mentioned shim plate S is replaceable with different thickness elements so as to obtain the desired relative velocity of fluid discharge exiting from the nozzle slot 1''' for obtaining uniform fluid distribution and coating onto the nozzle roller 4'. Dust particles and/or undissolved polymers, scale or semi-degraded material particles can, however, pass through the shim plate opening, assuming that the particle size is smaller than the shim plate thickness; and the effect of these is obviated in the process of roller transport in circular gap path A.

Figure 5:
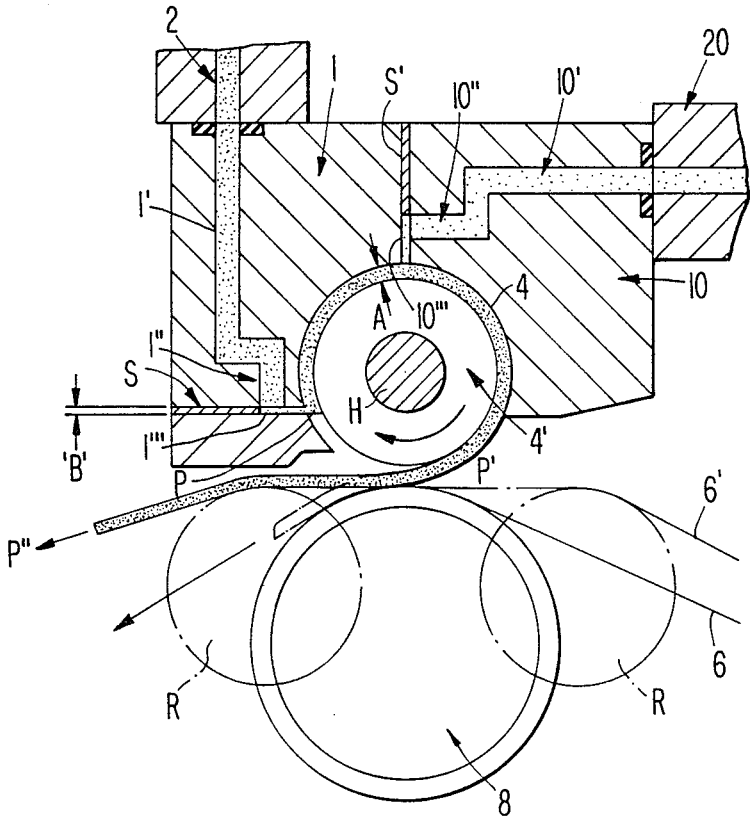
FIG. 5 is a view similar to FIG. 2 illustrating the practice of the invention with plural fluid component mixing.

It should be noted that the above descriptions outline only a single fluid supply through parallel inlets 1' (FIG. 3) into a single cavity 1'' for fluid distribution; and, therefore, the cavity design provides for uniform pressure drop resulting in uniform fluid distribution exiting from the nozzle exit slot surface 1'''. The invention, however, also permits the application of plural, such as dual, fluid component mixing for roll coating applications, as shown in FIG. 5. A second slot nozzle 10 with inlet 10', expansion chamber 10'' (again transversely into the drawing) and slot chamber 10''', is mounted as part of the housing structure, shown oriented orthogonally and fed from a second poppet valve assembly 20, enabling a second fluid to be proportionally mixed within the annular channel region 4 with the fluid from nozzle 1, with the mixed-fluid being applied at P' to a paper or film web 6 as in FIG. 1, or a film 6' shown as an alternative use with dotted rollers R in FIG. 5. This internal and proportion-controlled multiple fluid or fluid-component mixing facility enables, for example, catalyst and hot melt plastic fluids, (or multi-component epoxy-type fluids, or polymerization type plastics and the like), to be internally mixed without exposure to moisture, air, radiation or other environmental conditions that would precipitate reaction before application to the web or film. Once applied, the setting or polymerization or subsequent radiation curing of the mixed fluid components can take place as at P''.

It has been discovered, furthermore, that under certain coat weight ranges such as, for example, 10–15 GSM for EVA wax type hot melts, the surface speed of the roller 4' can be raised to substantially web speed, say approximately 95–100 percent, remarkably rendering the nozzle-roller coater of the invention adapted to print or lay down predetermined lengths and patterns intermittently with precision and with matched roller-web speeds. If the roller speed is too fast, the fluid puddles; whereas, if slower than web speed, the deposit does not produce full coating. With proper speed match, however, the fluid freely transfers to the web.

In summary, thus, the nozzle roller 4' serves as a means of transmitting the fluid coating for subsequent application to a web or sheet substrate material 6 or 6'. The housing member 4 surrounds the nozzle roller whereupon the cross sectional area between the outside diameter of the nozzle roller and the inside housing surface is filled with the coating fluid. The cross sectional area between the nozzle roller 4' and the housing member channel 4 serves as a means for holding the fluid to prevent fluid drainage and loss of fluid distribution on the surface of the nozzle roller and can be adjusted to accommodate the fluid properties of Newtonian, thixotropic and dilatant fluids, as well as those materials which are none of the above, such as Malcolm Nicol's Type 2-2419. Newtonian type fluids possess excellent laminar flow properties, in which the cross sectional area can be minimal. Thixotropic, dilatant or high viscosity materials, however, require larger cross sectional areas to overcome the poor flow properties, so that the desired fluid coating thickness on the nozzle roller exits at the discharge side P' of the housing member 4.

The rotational speed of the nozzle roller 4' (surface speed), together with a predetermined fluid coating thickness, mathematically correlates to web speed and resultant coating thickness applied to the web substrate. The following data was obtained for particular test installation.

As an example, using low viscosity EVA type material, having a viscosity of 150 cPs at application temperature, and a circular path gap A of 125 microns, a 5 GSM coat weight can be applied with an applicating nozzle roll speed rpm of 30, at a web speed of 15 MPM. Heavier coat weights of 10 GSM will be obtained by increasing the nozzle roller rotational speed to 60 and increasing the metering fluid supply by two times.

In a similar way, higher viscosity materials, such as pressure sensitive adhesive (PSA) of 24,000 cPs at application temperature, require a larger circulation path gap A of 250 microns, for applying coat weights ranging from 5 to 10 GSM. The viscous material of the PSA demands a larger circular path gap due to different laminar flow properties, yet provides for a small cross sectional laminar flow area for applying low coat weights of 5 to 10 GSM. Nozzle applicating roll rotational speed for a 5 GSM coat weight requires 10 rpm at 15 MPM. A 10 GSM coat weight requires approximately 20 rpm speed of the nozzle roller 4'.

Lastly, heavier coat weight deposits of the same PSA coatings noted above, ranging from 20 to 60 GSM, require a further increase in circular path gap A to 525 microns. For the same reasons as indicated earlier, viscous materials possess specific laminar flow properties. Such viscous materials contain areas designated as transient and laminar flow with respect to the rotating roll, in which the circular path gap A directly influences the coating thickness or weight of fluid deposited. Typically, a coat weight of 20 GSM requires a nozzle applicating rotational speed of 17 rpm, whereas a 60 GSM requires a nozzle applicating rotational speed of approximately 52 rpm.

Coating materials which have substantially higher viscosities, such as 50,000 to 100,000 cPs will require a larger circular path gap, in order to deposit similar coat weights as noted above. The circular path gap is dependent upon the rheology of the coating materials and their relative non-Newtonian, thyxotropic and dilatant characteristics. By varying the nozzle roller speed relative to web substrate surface speed, proportionally and synchronously, this will provide less or greater coating thickness as required for a given fluid supply coating to the nozzle roller.

In the case of, for example, thin plastic film web coating, FIG. 1, it should be noted that the web support back up roll 8 is located directly opposite the nozzle roller. The web substrate 6 must be supported by such heated back-up support roll system, in order to receive the fluid transfer from the nozzle roller. The nozzle roller 4' is positioned at P' with a pre-calculated gap above the surface of the web substrate, yet close enough for obtaining complete fluid transfer to the film substrate. Typically, a 25 micron fluid coating thickness applied to the web substrate, will require a nozzle roller gap to the back-up supporting roll, with web of approximately the same dimension as the coating thickness. Any desired change in coating thickness will require an increase in fluid supply rate, a decrease in nozzle roller diameter for obtaining the desired fluid coating thickness on the nozzle roll surface, and an increased nozzle roll gap to the back-up roll web support mechanism. In order to maintain uniform fluid coating thickness applied to the web substrate at different web speeds, the nozzle roller surface speed for fluid supply to the nozzle roll must, as before stated, be synchronous and proportional to web speed.

Figure 2:
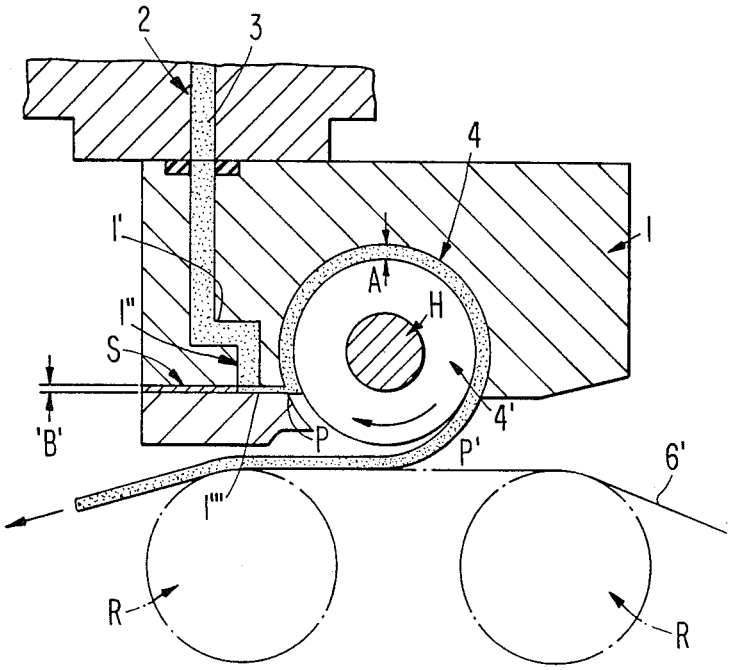
FIG. 2 is a similar diagram of a modified apparatus particularly adapted for paper substrates and the like of greater tensile strength.

Paper substrates or the like, FIG. 2, which contain substantially greater tensile strength and resistance to elongation during fluid application, yet also possess varying cross-sectional thicknesses, such as ±10%, do not require the use of the heated back-up roll web support mechanism as described in FIG. 1. In the event that the back-up web support mechanism is used for web substrates that contain varying thicknesses, the resultant coating thickness will also vary in proportion to the substrate thickness changes. In order to overcome this situation, the web support mechanism contains the before described pair of postioning rolls R, separated by sufficient distance in order to place the nozzle roller 4' between the two support rolls located on the opposing sides of the web and its relative support mechanism. Web tension, coupled together with positioning rolls R closely located to the nozzle roller, allowing for web substrate passage between the web positioning rolls and the nozzle roll without inducing a rigid fixed gap condition, provides for sufficient web substrate force against the nozzle roller for obtaining streakless fluid transfer.

As previously stated, the nozzle shim plate S is designed for obtaining full coating pattern widths or designated stripe coating patterns. In either case, the fluid supply rate is adjusted to accommodate the conditions for full coating or longitudinal stripe coating. The nozzle-roller coater, as also before explained, is capable of coating both room temperature, as well as elevated temperature fluids. It is possible that when coating room temperature liquids, the nozzle roll may, however, require heating, in order to improve the wetability and improve fluid coating transfer to the web substrate.

While the embodiments thus far described suggest that only multiple component materials applied to the exterior surface of the rotational nozzle applicating roller may be metered onto a moving substrate, it is possible to substitute for the nozzle applicating roller a hollow cylinder, in which the cross sectional wall is porous for allowing fluid flow from the interior to the exterior surface.

Figure 6:
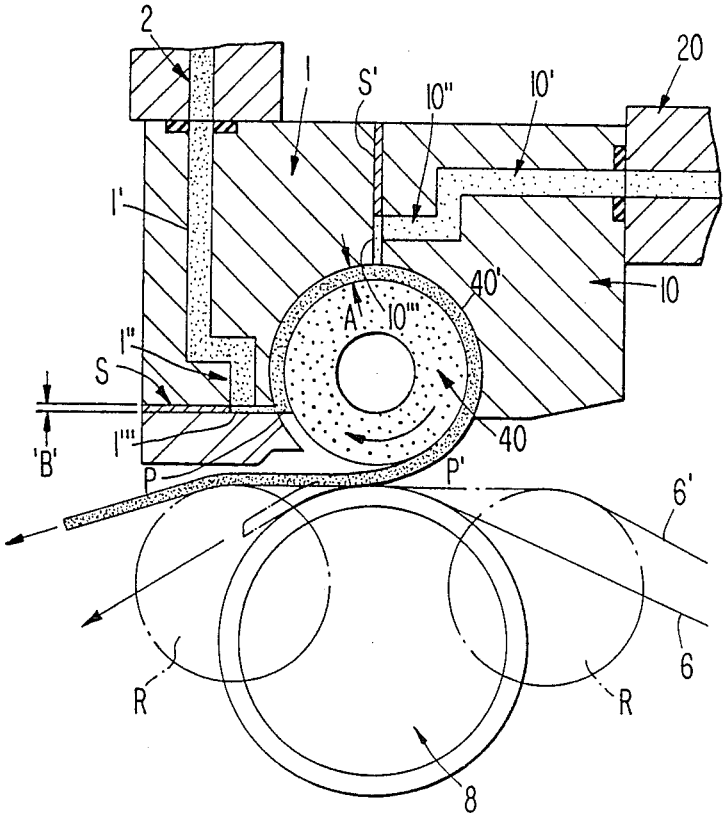
FIG. 6 is a modification of the embodiments of FIGS. 1 and 2 incorporating a porous roller for further fluid introduction.

Thus, if additional coating or other fluid input or mixing is required or desirable during the transit over the nozzle roller 4' within the circular path A, the roller 4' itself may assume an applicator form such as the porous shell or surface type roller 40 with an internal metered fluid reservoir as shown in FIG. 6, as of the type described in *Acumeter Laboratories bulletin*, 1986, "*For Cost Effective Tape And Label Manufacturing*", injecting fluid through the surface pores during the rotation of the roller. FIG. 6, like FIG. 5, shows this modification used either with a paper or film web 6 as in FIG. 1, or alternatively in use with dotted rolls R, as in FIG. 2.

A metered fluid supply synchronous to process speed, is connected to the center chamber 40' of the porous nozzle applicating roller 40 so that a proportional amount of fluid extruded through the outer wall member will mix with either a single component fluid from nozzle 1, FIG. 1, or with both fluids from nozzles 1 and 10, FIG. 5, in order to cause catalytic, polymerization, or other mixes such as those which require post radiation for cross-linking and final polymerization. The rotational speed of the porous nozzle applicating roller 40 is somewhat less than web speed resulting in mixing of multi-component fluids caused by differential surface speed of the web substrate and the nozzle applicating roller.

Further modifications will also occur to those skilled in this art, including unitizing the coaxial roller applicator 4—4' with other fluid nozzle applicators for the purposes herein and or similar uses; or orienting the slot nozzle-roller coating longitudinally along the web; all such being considered to fall within the spirit and scope of the invention as defined in the appended claims.

What is claimed is:

1. A method of eliminating streaking effects caused by entrapped particulate matter and the like in the applicating of fluid coating material transversely along a moving web-substrate, that comprises, metering the fluid material along a zig-zag path with transverse expansion intermediate the path parallel to the transverse dimension of the web to produce at an exiting region a flowing transverse sheet of the material with substantially uniform pressure drop and fluid displacement therealong; impinging the sheet of material on an immediately adjacent rotatable transversely extending cylindrical surface of rotational axis parallel thereto to form a coating on said cylindrical surface; rotating the cylindrical surface about its axis to carry the coating upon the cylindrical surface along a circular path away from the region of exiting, said circular path being at least partly bounded by said transversely extending rotating cylindrical surface and a coaxial closely spaced transversely extending cylindrical outer surface, the coating upon said rotating cylindrical surface being carried within a transversely extending annular space between the coaxially disposed cylindrical surfaces; drawing the web-to-be-coated past and immediately adjacent a further region of the circular path to cause the rotating cylindrical surface to apply and meter the coating carried thereby to the web substrate; and adjusting the said immediately adjacent positions of the rotating cylindrical surface from the exiting region and the web substrate from the further region of the circular path, while adjusting the cylindrical surface rotational speed synchronously with relation to web speed and the fluid metering, to determine the resultant coating thinness and streakfree nature of the coating.

2. A method as claimed in claim 1 and in which a further fluid or fluid component is introduced along said rotating cylindrical surface at a region subsequent to said exiting region, to enable mixing with the sheet material before reaching said further region of the said circular path.

3. A method as claimed in claim 1 and in which said cylindrical surface is porous and fluid is dispersed through the pores thereof during rotation of the cylindrical roller means along said circular path.

4. A method as claimed in claim 1 and in which a further fluid or fluid component is introduced into said annular space to enable fluid mixing before reaching said further region of the said circular path.

5. A method as claimed in claim 1 and in which the region of exiting of the transverse fluid sheet and the further region of metered application of the fluid material to the web substrate are disposed more than 90° of displacement from one-another along said circular path.

6. A method as claimed in claim 5 and in which the angle of displacement is greater than about 300°.

7. A method as claimed in claim 1 and in which the said region of exiting of the transverse fluid sheet is below the equatorial diameter of the rotating cylindrical surface and the said further region of metered application of the fluid material to the web substrate is at a polar region of the rotating cylindrical surface.

8. A method as claimed in claim 1 and in which the thickness of the exiting transverse sheet of fluid material is adjusted by varying the thickness of the region of exiting from the zig-zag path.

9. A method as claimed in claim 8 and in which the exiting transverse sheet is divided into parallel stripes.

10. A method as claimed in claim 1 and in which the said fluid metering is effected continuously or intermittently.

11. A method as claimed in claim 1 and in which said fluid coating material is of hot melt fluid.

12. A method as claimed in claim 11 and in which the rotating cylindrical surface is heated.

13. A method as claimed in claim 1 and in which the diameter of the rotating cylindrical surface and its rotational speed are varied in accordance with the desired transverse coating width and coating weight.

14. A method as claimed in claim 1 and in which the web substrate is one of a film web and a paper web.

15. A method as claimed in claim 1 and in which the web substrate is drawn past said further region by a back-up roll cooperating with the rotating cylindrical surface, the web being drawn between said back-up roll and said rotating cylindrical surface.

16. A method as claimed in claim 15 and in which said back-up roll is resilient and is temperature-controlled.

17. A method as claimed in claim 1 and in which the web substrate is drawn past said further region by a pair of rolls straddling the rotating cylindrical surface to apply the coating to the web substrate between the pair of rolls.

18. A method as claimed in claim 1 and in which the transverse sheet and rotating cylindrical surface are oriented parallel to the direction of moving of the web.

19. A method of eliminating streaking effects caused by entrapped particulate matter and the like in the applicating of fluid coating material transversely along a moving web substrate, that comprises, metering the fluid material along a path and producing at an exiting region a transversely extending flow of the material; impinging the transversely extending flow of fluid material on an immediately adjacent rotatable transversely extending cylindrical surface of rotational axis parallel thereto to form a coating on said cylindrical surface; rotating the cylindrical surface about its axis to carry the coating upon the cylindrical surface along a circular path away from the region of exiting, said circular path being at least partly bounded by said transversely extending rotating cylindrical surface and a coaxial closely spaced transversely extending cylindrical outer surface, the coating upon said rotating cylindrical surface being carried within a transversely extending annular space between the coaxially disposed cylindrical surfaces; drawing the web-to-be-coated past and immediately adjacent a further region of the circular path to cause the rotating cylindrical surface to apply and meter the coating carried thereby to the web substrate; and adjusting the said immediately adjacent positions of the rotating cylindrical surface from the exiting region and the web substrate from the further region of the circular path, while adjusting the cylindrical surface rotational speed synchronously with relation to web speed and the fluid metering, to determine the resultant coating thinness and streakfree nature of the coating.

20. A method as claimed in claim 19 and in which said further fluid or fluid component is introduced into said annular space to enable fluid mixing before reaching said further region of the said circular path.

21. A method as claimed in claim 19 and in which said cylindrical surface is porous and fluid is dispersed through the pores thereof during rotation of the cylindrical roller means along said circular path.

22. Apparatus for streakless transverse fluid coating of a moving web substrate having, in combination, transverse line nozzle applicator means receiving metered pressurized fluid coating material and exiting the same through an opening as a transverse sheet; cylindrical roller means disposed immediately adjacent said opening and extending axially parallel thereto to receive the exiting transverse sheet of fluid material as a coating upon an adjacent region of the cylindrical surface of the roller means; means for rotating said cylindrical surface about its axis to carry the coating upon said cylindrical surface away from the opening along a circular path of travel of the roller means to a further region of said circular path where the coating is to be applied to the web substrate, said cylindrical roller means being coaxially surrounded at least in part with a closely spaced outer housing cylindrical surface to define a circular gap therebetween along which fluid material received from said opening is carried and from which said material is exited at said further region; and means for adjusting the separation between said opening and said roller means and the rotational speed of the roller means with respect to the fluid metering and web substrate speed to determine the resultant coating thinness and its streak-free nature.

23. Apparatus as claimed in claim 22 and in which the opening comprises a slot and the applicator means is provided with a zig-zag path of flow of the pressurized fluid coating material containing intermediately a transverse narrow expansion chamber that produces a substantially uniform fluid pressure drop and fluid displacement along the slot and against said adjacent region of the roller means.

24. Apparatus as claimed in claim 23 and in which said transverse expansion of the fluid coating material in the applicator means is effected from a single fluid inlet metering supply as for fluid coating materials with Newtonian flow properties.

25. Apparatus as claimed in claim 22 and in which said cylindrical roller means comprises a porous roll from within which fluid is dispersed through the pores of the roll along said circular path of travel.

26. Apparatus as claimed in claim 22 and in which said adjacent region of the roller means opposite said slot is below or near the equatorial diameter of the roller means and said further region of metered application to the web substrate is at or near a polar region of the roller means outside said housing.

27. Apparatus as claimed in claim 22 and in which a back-up roll is provided for carrying said web past said further region.

28. Apparatus as claimed in claim 22 and in which means is provided for carrying the web substrate along a path past said further region including a pair of rolls on opposite sides, respectively of said further region of the roller means.

29. Apparatus as claimed in claim 22 and in which said opening comprises a slot and in which shim means is provided at said slot for adjusting the effective thinness of the sheet of fluid coating material exiting therefrom and upon the roller means for enabling full stripe and parallel stripe patterns as desired.

30. Apparatus as claimed in claim 22 and in which said fluid material is hot melt fluid.

31. Apparatus as claimed in claim 22 and in which the dimensions and rotational speed of the roller means are adjusted in accordance with the desired transverse coating width and weight to meter the coating applied from the roller means rotating within the housing to the web substrate at said further region.

32. Apparatus as claimed in claim 22 and in which means is provided for introducing a further fluid or fluid component into said gap at a region in advance of said further region to enable fluid mixing prior to said further region.

33. Apparatus as claimed in claim 32 and in which said further fluid introducing means comprises a further slot nozzle means mounted with said housing and provided with means for enabling proportional mixing.

34. Apparatus as claimed in claim 32 and in which said fluids are selected from the group consisting of hot melt plastic fluids, catalyst and multi-component epoxy-type fluids and polymerization type plastics including radiation-curable materials.

* * * * *